US006780800B2

(12) United States Patent
Itoh

(10) Patent No.: US 6,780,800 B2
(45) Date of Patent: Aug. 24, 2004

(54) SINGLE LAYER TEXTILE FOR MANUFACTURING CONSTRUCTION MATERIAL

(75) Inventor: Senri Itoh, Tokyo (JP)

(73) Assignee: Nippon Filicon Co., Ltd., Tokyo (JP)

( * ) Notice: Subject to any disclaimer, the term of this patent is extended or adjusted under 35 U.S.C. 154(b) by 91 days.

(21) Appl. No.: 10/176,050

(22) Filed: Jun. 21, 2002

(65) Prior Publication Data

US 2003/0015248 A1 Jan. 23, 2003

(30) Foreign Application Priority Data

Jun. 22, 2001 (JP) ..... 2001-226777

(51) Int. Cl.[7] ..... D03D 15/00

(52) U.S. Cl. ..... 442/190; 442/191; 442/208; 139/383 A; 162/903

(58) Field of Search ..... 442/190, 191, 442/208; 139/383 A; 162/903

(56) References Cited

U.S. PATENT DOCUMENTS

| | | | |
|---|---|---|---|
| 4,105,495 | A | 8/1978 | Pai |
| 6,234,213 | B1 | 5/2001 | Kobayashi et al. |
| 6,284,678 | B1 | 9/2001 | Kobayashi et al. |
| 6,397,899 | B1 | 6/2002 | Kobayashi et al. |

*Primary Examiner*—Elizabeth M. Cole
(74) *Attorney, Agent, or Firm*—Rader, Fishman & Grauer PLLC

(57) ABSTRACT

A single layer textile for manufacturing a construction material is obtained by weaving warps and wefts. Each of the warps are selected from a monofilament, a monofilament twine and a core line yarn having a core line of a monofilament, and a bundled yarn having small-diameter raw yarns bundled to form fine water sucking spaces between the raw yarns. The wefts contain both monofilaments and the bundled yarns.

12 Claims, 2 Drawing Sheets

SINGLE LAYER TEXTILE FOR MANUFACTURING CONSTRUCTION MATERIAL

TECHNICAL FIELD OF THE INVENTION

The present invention relates to a textile for manufacturing a construction material, which is used in a construction material manufacturing machine for manufacturing construction boards such as slates and tiles.

BACKGROUND OF THE INVENTION

Manufacturing methods of construction materials such as slates, tiles, and so on, are well-known techniques. The methods include steps of dissolving slurry in which a material such as cement, pearlite, plaster, slag, aggregate, organic fibers, asbestos, or the like into water, forming the slurry at a forming part, and transferring the slurry to a press part, where the construction materials are manufactured through steps such as press water suction, molding, dies cutting, and so on.

In the forming part and press part of a construction material, and a transfer part for transferring a construction material sheet, hitherto, a textile in which monofilaments or multifilaments are woven with each other, a so-called needle felt in which, using this as a base cloth, batts of synthetic fibers are cross-linked by needling on the front surface, back surface of the base cloth, and a textile woven by monofilaments, a textile woven with monofilaments and multifilaments, and so on, have been used. Since the felt is a structure filled with fine synthetic fiber batts from the front surface to the back surfaces, there has been no leak of the material in which a very fine powder-like material is the main body and a construction material sheet of desired thickness and basis weight can be formed, it has been suitable for a single-layer textile for manufacturing a construction material. However, although retention is good, there has been a problem that washing for removing the material, chemical, or the like, coming into the felt, is very difficult. Besides, because of the structure filled with the fine synthetic fiber batts, the material or the like coming into a layer is difficult to remove, and the material or the like remaining in the textile without being completely removed may cause sucking spots, or the batt fibers are broken by an impact of a high-pressure washing shower for removing the remaining material or the like, and holes may be generated. In addition, since the cushioning property and the nip resistance are bad, the break of batt is generated with being used, it is gradually compressed, and the thickness decreases, and there was also a problem that the water extraction ability is lowered accordingly.

Besides, there are also defects that the extensional rigidity, the flexural rigidity, and the stability of dimension and posture are not enough. For well running the felt on which a construction material rides, although it is necessary to surely transmit the force of a drive roll in a state of applying a tension to the felt, since the needle felt is small in extensional rigidity, the stability of dimension and posture is insufficient, and in addition, the width shrinkage generated in accordance with an elongation and a decrease in thickness are large, it was difficult to well run with applying a large tension. Upon running, there is also a problem of a slip, and if a slip is generated, the wear on the running surface side of the felt is promoted, the duration is shorten, problems that the electric power burden increases and the machine stops, and so on, are generated, and there may be a case of exerting a serious influence on the productivity. In addition, since the felt is weak in flexural rigidity, it can not bear the weight of the material, a strain is generated, and there might be also a case that a break or a crack is generated in the construction material sheet.

So, other than the needle felt, a textile woven by monofilaments laying emphasis on washability, rigidity, and a multilayer textile in which monofilaments and multifilaments are combined and disposed, has been used. But, although the textile constructed by the monofilaments is superior in washability, rigidity, since through off of fine particle material is much and the retention is insufficient, it can not satisfy the conditions required for construction material manufacture, besides, since fine fiber spaces effective for water suction are not present, the water sucking ability is insufficient, the flexibility and the cushioning property are lacked, since the construction material sheet is broken under a high nip pressure, it was very difficult to satisfy the conditions required in the press step.

Besides, although the multilayer textile in which monofilaments and multifilaments are combined and disposed is superior in water sucking ability because fine fiber spaces are present, since it is a multilayer structure in which many multifilaments are used in a layer, there was a problem that the washability of stain and material coming into a layer is bad. Besides, since the multilayer textile in which monofilaments and multifilaments are combined and disposed is a multilayer structure, the warps are woven in from the upper layer to the lower layer and upward and downward crimps are formed, the crimp of the warp is formed by the warp which was originally a linear filament being woven with the weft crossing it, when the textile is used under a high tension, since it intends to return to be linear by a force vertically elongated, the filament whose crimps are large, and many, is larger in elongation quantity than a filament whose crimp shape is small and the number of them is little. Therefore, although the multilayer textile has a merit of having two characteristics suitable respectively on the upper layer side and the lower layer side, there was a problem that it is apt to elongate by the tension.

Thus, in the needle felt having been used for forming, press, transfer, and so on, of the construction material manufacturing machine, and the textile woven by monofilaments and multifilaments, satisfactory effects could not be performed in view of the retention of the material, washability, shower resistance, the water sucking ability, the extensional rigidity, durability and the construction material board formation.

SUMMARY OF THE INVENTION

The present invention is in view of the problems of the prior art and to provide a textile used in a machine for manufacturing a construction material used for construction material forming and press, construction material sheet transfer wherein a retention of the material is good and which is superior in washability, extensional rigidity, durability, and construction material board formation.

The present invention relates to a single layer textile for manufacturing a construction material, which is obtainable by using in combination and weaving a warp yarn and a weft yarn. The warp yarn includes a monofilament selected from a group of a monofilament, a monofilament twine and a yarn having a core line of a monofilament, or a monofilament selected from a group of a monofilament, a monofilament twine and a yarn having a core line of a monofilament and a yarn in which small-diameter raw yarns are bundled to form fine water sucking spaces between the raw yarns. A weft yarn includes a monofilament and a yarn which small-diameter raw yarns are bundled to form fine water sucking spaces between the raw yarns.

The warp yarn may contain a monofilament selected from a monofilament, a monofilament twine, a yarn having a core line of a monofilament, and a yarn in which these yarns and small-diameter raw yarns are bundled to form fine water sucking spaces between the raw yarns; the weft yarn may be one in which monofilaments and small-diameter raw yarns are bundled to form fine water sucking spaces between the raw yarns; one warp always may form a knuckle on the upper side of the same kind of weft; and the warp may comprise two kinds of warps different in crimp shape.

There may be alternately disposed wefts in which monofilaments and the small-diameter raw yarns are bundled to form fine water sucking spaces between the raw yarns; and a tissue of the warps may comprise two warps which are (i) a warp passing over the upper side of one monofilament weft, and next passing under a weft in which continuous small-diameter raw yarns are bundled to form fine water sucking spaces between the raw yarns, a monofilament weft and a weft in which the small-diameter raw yarns are bundled to form fine water sucking spaces between the raw yarns; and (ii) a warp passing over the upper side of a weft in which the small-diameter raw yarns are bundled to form fine water sucking spaces between the raw yarns, and next passing under a continuous monofilament weft, a weft in which the small-diameter raw yarns are bundled to form fine water sucking spaces between the raw yarns and a monofilament weft.

The the yarn selected from the monofilament, the monofilament twine and the yarn having the core line of the monofilament may be no less than 30% of the total textile construction yarns.

The yarn in which the small-diameter raw yarns are bundled to form the fine water sucking spaces between the raw yarns, may be a yarn selected from a span yarn, a multifilament, a raising yarn, a monofilament twine, a mole yarn, a filament process yarn, a yarn in which a span yarn is wound on the core line of a monofilament, or a yarn in which at least two kinds of these yarns are co-twined.

The yarn having the core line of the monofilament may be a yarn in which a span yarn or a multifilament is wound on the core line of a monofilament.

PREFERRED EMBODIMENTS OF THE INVENTION

Figure 1:
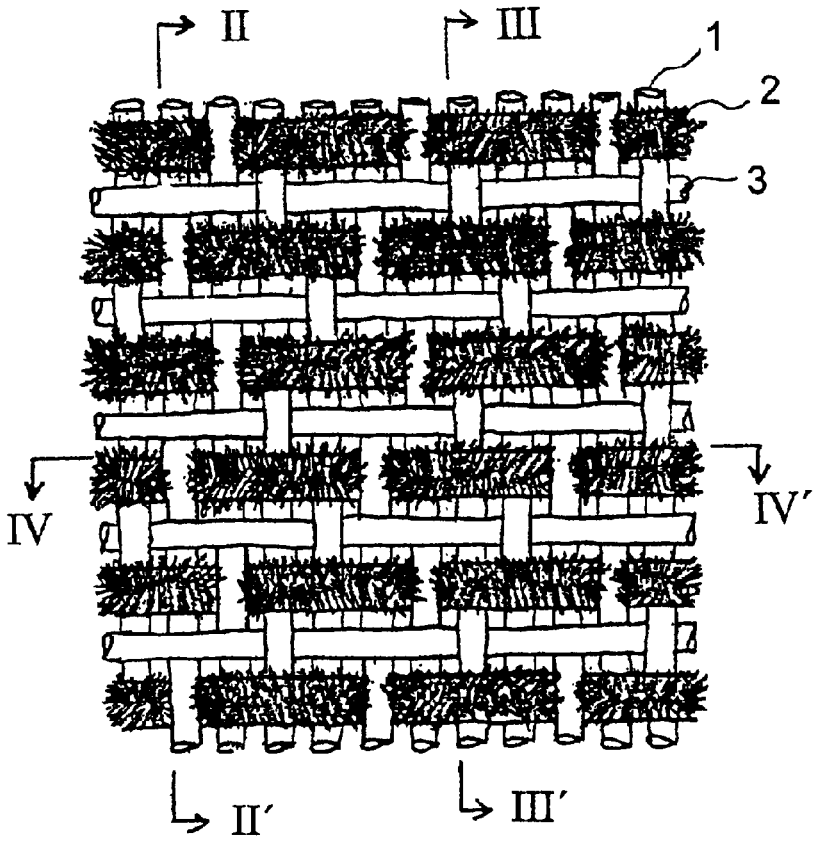
FIG. 1 is a plan view on the sheet formation surface side of an example of a textile of the present invention for forming and pressing construction material.

The construction material manufacture is in general that slurry in which a material such as cement, pearlite, plaster, slag, aggregate, organic fibers, asbestos, or the like, is dissolved in water, is formed in a forming part using a forming textile, and after this, it is transferred to a press part, a construction material sheet is put on a textile for press, or the construction material sheet is sandwiched from the upper and lower sides by textiles for press, or the sheet is water-suctioned with pressing by molds, and it is manufactured through steps such as molding, dies cutting, and so on.

In the forming part, as the slurry is put on the textile and transferred, moisture contained in the slurry is exhausted through the textile. For more efficiently dehydrating the moisture, there are many cases that a forcible suction apparatus is disposed on the running surface side of the textile, and the retention in which through off of the material is not generated even by strong suction, and superior washability capable of easily dropping the material and stain coming into the textile, has been required. Besides, in the press part, because of the use under a high nip pressure, a proper cushioning property becomes necessary for obtaining rigidity, and a superior water sucking ability, and since the textile is always used under a high tension, it is necessary to have extensional rigidity hard to elongate even by the tension.

In the present invention, a textile of a structure to satisfy the washability, the retention, the extensional rigidity, and so on, which could not be solved by the felt, and the textile using a monofilament, and a multifilament have been used hitherto, is provided.

The textile of the present invention is a single layer textile for manufacturing a construction material used in the construction material forming part or press part or the construction material sheet transfer part in a construction material manufacturing machine, and exhibits superior effects in view of the retention of the material, the washability, the rigidity, the showering resistance, the extensional rigidity, the water sucking ability, and the construction material formation.

Since the textile of the present invention is a textile woven using a yarn in which small-diameter raw yarns are bundled to form fine water sucking spaces between the raw yarns in part of at least any one of a warp and a weft, thereby forming the fine water sucking spaces as in a felt, because the binding power of fibers is strong, there is no dropped out of a construction yarn fiber, and there is a merit that a wire mark may not be given to the sheet. Furthermore, since it is a textile woven using a yarn which forms fine water sucking spaces, the retention of the material is good, and the water sucking ability is also good. On the other hand, since that textile is a structure in which a monofilament is used in at least part of a warp, there is extensional regidity, it is superior also in rigidity, and since it is made into a textile of a single layer construction, the shower resistance ability and the washability also became good.

And, also in view of the extensional rigidity which could not be solved by the conventional textile, in the present invention, by combining the disposition, texture, and structure of a specific yarn, it could be solved.

As a characteristic of the textile of the present invention, a monofilament is disposed in a warp, two different yarns of yarns in which monofilaments and small-diameter raw yarns are bundled to form fine water sucking spaces between the raw yarns, are disposed in a weft, by making the disposition and the texture of a structure in which the warp always forms a knuckle on the upper side of the same kind of weft, two warps different in crimp shape are disposed, even if the warp elongates by a tension, since the maximum value of the elongation quantity on the side in which the crimp shape is large, and the maximum value of the elongation quantity on the side in which the crimp shape is small, are different, even if the crimp on the side in which the crimp shape is large, elongates, since the crimp on the side in which the crimp shape is small, elongates not so much, it becomes hard to elongate as the total textile. Further, in the textile of the present invention, since it is a single layer structure, since the number of crimps and the size of the crimp are small in comparison with a multilayer textile, it became a textile hard to elongate. By the weft using different kinds of yarns in which the monofilaments and the small-diameter raw yarns are bundled to form the fine water sucking spaces between the raw yarns, it can be made as the warps different in crimp shape.

Also other than the rigidity as the textile used in the machine for manufacturing a construction material, for obtaining a good construction material product in which the moisture content of the sheet is small and there is no generation of marks, a textile of a structure having fine water sucking spaces and a fine mesh surface is preferable, and the textile of the present invention is also preferable to be a structure in which many yarns having fine water sucking spaces on the surface on the sheet surface side, appear.

Furthermore, to improve the showering resistance ability and the washability in problem in the felt, it was made into a woven fabric structure constructed using a yarn in which fine water sucking spaces are formed, and a monofilament, without using batt. Because of the single layer structure, even if the material comes into the textile, it can be easily removed by high-pressure shower washing, and since the cushioning property is small in comparison with a textile of a multilayer structure, even in repeated press, the fabric thickness decrease ratio is very low, and thereby lowering of the water sucking ability can be suppressed.

As the water sucking ability and mark measures, by using a yarn in which small-diameter raw yarns are bundled to form fine water sucking spaces between the raw yarns, in the textile construction yarn, the problem could be solved.

It will be described hereinafter in detail how the textile thus constructed functions on the construction material manufacturing machine and sucking is performed.

A construction material goes toward the press part through the forming part. In the forming part, slurry made of a fine particle material is supplied on the running forming texture and the moisture is removed to some extent by gravity or a suction apparatus, and in the press part, it is pressed by a roll or mold. The surplus moisture of the slurry put on the textile moves to the textile, the yarn having fine water sucking spaces constructing the textile is made function as a continuous conduit, the moisture is concentrated on the running surface side by a capillary phenomenon, and it is efficiently dehydrated by a forcible suction apparatus such as a suction box or the like, or press or the like.

The conditions desired in the forming process are that, even if it is sucked from the running surface side of a textile using a fine material and by a forcible suction apparatus, there is no leak of the material, and in spite of this, it is made into a textile superior in dehydrationability and in which a wire mark is not given to the construction material sheet. Moreover, the water sucking ability is improved by the cushioning property to a proper degree also in the press process, and a textile superior in elongation and rigidity in which a break and a crack are never generated in the construction material sheet by generation of bending, was required.

Since the total of the textile woven using a yarn in which small-diameter raw yarns are bundled and which has fine water sucking spaces between the raw yarns, has a woven fabric structure though it is a congregation of thin fibers like the batt of the needle felt, to a warp in case of a weft, to a weft in case of a warp, they are woven in each other at a short period, since it is strongly bound, it is superior in rigidity, since a decrease in thickness is little, there is no case that the water sucking spaces are crushed and it is never to break and drop off by the collision of shower water. Besides, since the textile of the present invention is not a structure in which fine fibers are crowded in the total of a Z-axis direction, but a single layer structure comprising a yarn having fine water sucking spaces which is a congregation of fine fibers, and a monofilament, stain is hard to accumulate, and also stain coming into the layer can be easily removed by shower or the like. Besides, the yarn in which the small-diameter raw yarns are bundled and which has the fine water sucking spaces between the raw yarns, is superior also in showering resistance ability, and it can sufficiently endure a high-pressure shower.

Thus, the textile of the present invention can prevent through off of the material upon the construction material manufacture, can obtain a sufficient water sucking ability also upon press, and exhibits a superior effect also in sheet forming. Besides, by making into a structure having two warps different in crimp shape, an extensional rigidity of the textile can be given, the stain and the material in the textile can be easily removed also upon washing of the textile, and it can be made into a textile superior also in showering resistance ability.

The combination of the warp and weft constituting the textile is that the warp is at least one kind of yarn selected from a monofilament, a monofilament twine, a yarn having a core line of a monofilament, or a yarn in which a yarn containing at least one kind of monofilament selected from a monofilament, a monofilament twine, a yarn having a core line of a monofilament, and small-diameter raw yarns are bundled and fine water sucking spaces are formed between the raw yarns, and the weft uses in combination of a monofilament and a yarn in which small-diameter raw yarns are bundled to form fine water sucking spaces between the raw yarns, a warp containing monofilament is always woven with the same kind of weft to be a yarn forming a knuckle of the same shape, and by making into a structure in which the warp is different crimp shapes, that is, two kinds of warps different in the size of crimp are disposed, an extensional rigidity can be given.

As for the disposition ratio of the yarn in which the fine water sucking spaces are formed and the monofilament (or, the monofilament twine or the yarn having the core line of a monofilament inclusive, a warp and a weft also inclusive), the disposition ratio of the monofilament may be not less than 30% of the total of the textile, and by the other conditions such as the material, machine, and so on, in this range, it can be properly changed. In case that the disposition ratio of the monofilament is not more than 30%, the textile rigidity tend to lack, upon forming, or the use under a high tension upon press water sucking becomes difficult, even though the textile may still be used. Since the monofilament has a role of rigidity and dimension stability improvement, if the ratio of the monofilament is increased, it is superior in rigidity and it can sufficiently endure also high-pressure washing. Therefore, in part of the warp, it may be a structure in which a yarn in which a monofilament is contained is disposed. On the other hand, if the ration of the yarn having the fine water sucking spaces is made much, although the water sucking ability an the retention of the material are apt to improve, they are not always in proportional relation, and as for the disposition ration of the yarn, it is determined after considering various conditions and characteristics required for the construction material to be manufactured.

As for the texture, it may be a structure in which the warp containing a monofilament forms crimps of two kinds of shapes. It may also be a structure in which a yarn containing a monofilament is disposed in the warp, or a yarn in which small-diameter raw yarns are bundled to form fine water sucking spaces between the raw yarns is used together with the yarn containing the monofilament. But, since the yarn having that fine water sucking spaces is a material quality easy to elongate, since it can not be an elongating resistance yarn, it is preferable to be a structure in which the yarn containing the monofilament is disposed in at least part of the warp. In the weft, a monofilament and a yarn in which small-diameter raw yarns are bundled to form fine water sucking spaces between the raw yarns, may be combined and disposed. Also as for the disposition ratio and disposition order, although it is not particularly limited, for making such a structure as one warp is always woven with the same yarn, it is required to consider the texture of the warp and the disposition ratio, disposition order, and so on of the weft.

Particularly in case of alternately disposing two kinds of wefts, if it is made into a structure in which, after the warp passes on the upper side of one weft, it passes on the lower side of three wefts, since it is a structure in which it is always woven with the yarn on the same kind of weft, it is preferable. Besides, it is not limited to this, and the disposition of two wefts and the texture of the warp may be changed. But, since it is a single layer structure, if it is so long crimp, since the stability or the like of the textile becomes bad, it must be a texture in which the crimp is not so long.

The yarn in which the small-diameter raw yarns used here are bundled and which has the fine water sucking spaces between the raw yarns, is, for example, a span yarn, a multifilament, a raising yarn, a monofilament twine, a mole yarn, a filament process yarn, a yarn in which a span yarn is wound on the core line of a monofilament, a yarn in which a span yarn is wound on the core line of a multifilament, or a yarn in which at least two or more of these are co-twined.

It is to be noted that, in this specification, the span yarn means one in which short fibers are bundled to be yarn-like, and a spun yarn or the like. Moreover, the multifilament is one in which long fibers are twined to be yarn-like, the raising yarn is one in which the surface of a multifilament is scratched by needle-like one to be napped, and the filament process yarn is a yarn-like body in which an expansion and contraction process, a bulking process, a burring process, or the like, is applied to a filament yarn, and a meaning containing a yarn called, in general, a textured yarn, a bulky yarn, a stretch yarn, or a Taslan process yarn, and wooly nylon and so on are contained in this. The mole yarn is one in which short fibers are radially disposed around a core yarn of a multifilament or the like to be yarn-like. One in which a burring process or the like is applied to the short fibers radially disposed is also contained.

As for the material quality of the yarn used in the present invention, it is not particularly limited, and various material qualities such as a synthetic fiber such as polyester, polyamide, polyphenylene sulfide, or the like, a chemical fiber such as rayon or the like, a natural fiber such as cotton or the like, and so on, can be used. In case of using polyamide in the weft material quality, the nip resistance property and fibrillation resistance property to press become good, and in case of using polyester, since the rigidity becomes large, it is preferable to select the material quality of the yarn in accordance with application.

EXAMPLES

Figure 5:
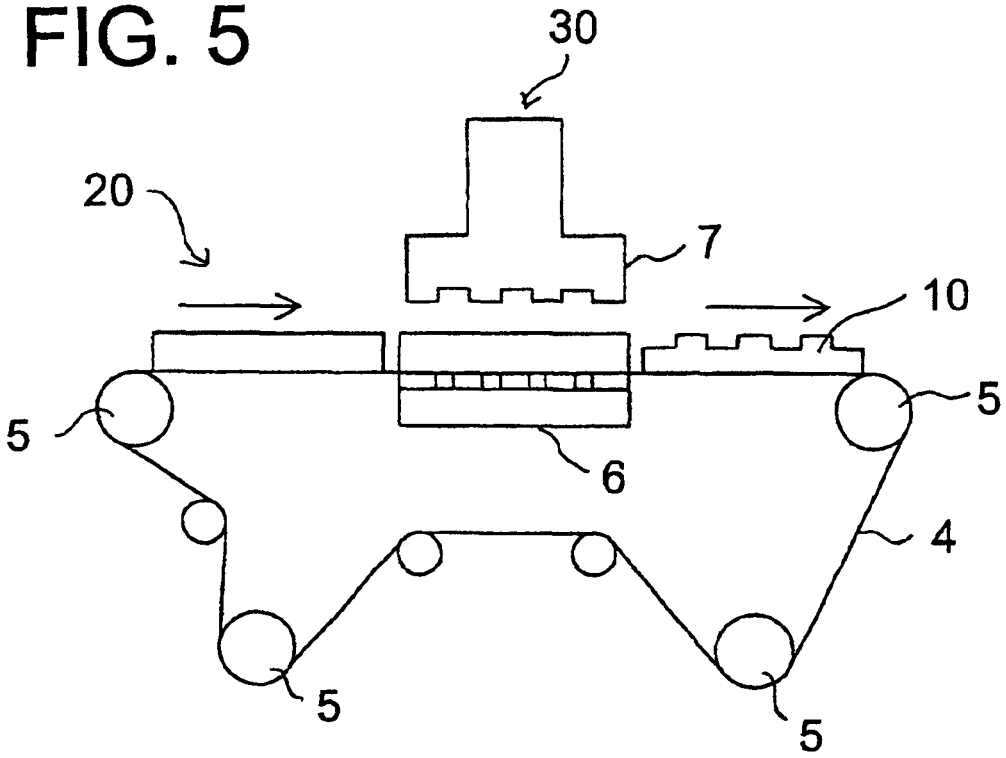
FIG. 5 is a plan view showing part of a construction material manufacturing apparatus.

The present invention will be described based on examples with reference to drawings. FIG. 5 is part of a construction material manufacturing apparatus using a single layer textile 4 for manufacturing a construction material 10. The apparatus has a sheet forming part 20 and a press part 30. It is an apparatus of Fourdriner machine in which a forming textile 4 is place and inserted between rolls 5, a mold 7 is disposed on the press surface side as the upper portion side of the textile 4 and a suction box 6 is disposed on the running surface side as the lower portion side of the textile 4 with sandwiching the textile 4, a stock is supplied onto the textile 4, transferred, and water-suctioned by pressing by the mold 7, and the surplus moisture is sucked by the suction box 6. In addition to this type of apparatus, any type may be used in the present invention.

FIGS. 1, 2, 3, and 4 show an example of the single layer textile for manufacturing a construction material of the present invention. FIG. 1 shows the sheet forming side surface of the textile used in the sheet forming part 20 and the press part 30 of FIG. 5. Warps 1 are woven with wefts 2 and 3. The wefts 2 are bundled yarns in which small-diameter raw yarns are bundled and which has fine water sucking spaces between the raw yarns. The wefts 3 are monofilaments.

Figure 2:
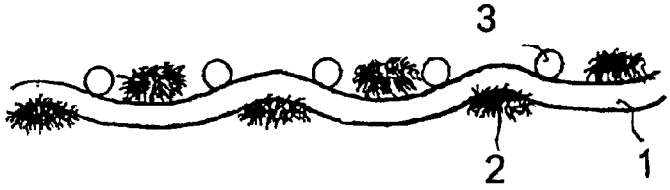
FIG. 2 is a sectional view of the textile along a warp of the line II–II' of FIG. 1.

FIG. 2 is a sectional view along a warp cut along the line II–II' of FIG. 1. The warp 1 shown in FIG. 2 has a texture in which the warp 1 passes over the upper side of one weft, and next passes under continuous three wefts. Particularly, the warp 1 passes over a bundled yarn 2 in which small-diameter raw yarns are bundled and which has fine water sucking spaces between the raw yarns, and always passes over the bundled yarn wefts 2.

Figure 3:
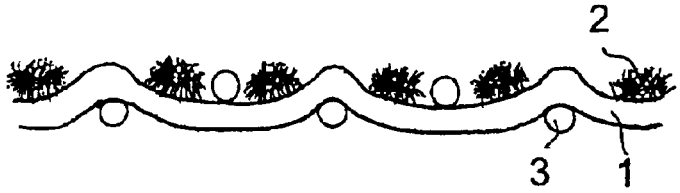
FIG. 3 is a sectional view of the textile along a warp of the line III–III' of FIG. 1.

FIG. 3 is another sectional view along the warp 1 cut along the line III–III' of FIG. 1. The warp 1 shown in FIG. 3 has a texture in which the warp 1 passes over the upper side of one weft, and next passes under continuous three wefts. Particularly, the warp 1 shown in FIG. 3 passes over a monofilament 3, and always passes over the monofilament wefts 3.

Figure 4:
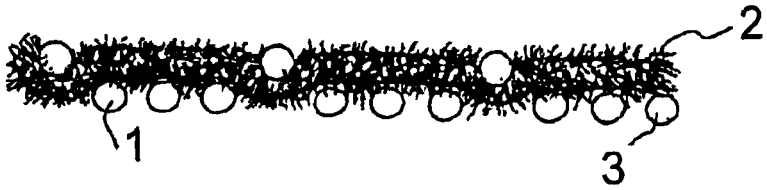
FIG. 4 is a sectional view of the textile along a warp of the line IV–IV' of FIG. 1.

FIG. 4 is a sectional view along the bundled yarn weft 2 cut along the line IV–IV' of FIG. 1. The warp 2 shown in FIG. 4 has a texture in which the weft 2 passes under the upper side of one warp 3, and next passes over continuous three warps 3.

Example 1

The warps 1 disposed are polyester monofilaments of a diameter of 0.5 mm in 36 per one inch. The wefts 2 and 3 are polyamide mole yarns of a diameter of 0.5 mm and polyester monofilaments of a diameter of 0.85 mm, respectively. The wefts 2 and 3 are alternately disposed in 20 per one inch in combination, and woven with the warps. The warp texture is that a warp is disposed over one weft and disposed under three consecutive wefts, that forms 4 shafts of a repeating unit as shown in FIG. 1. The warp textures are shown in FIG. 2 and FIG. 3. By making into such a structure, there are two types of warps, one type of which always passes over the polyamide mole yarn wefts and the other type of which always passes over the polyester monofilament wefts.

COMPARATIVE EXAMPLES

Next, showing as to a multilayer textile constructed from a monofilament of a prior art, a multilayer textile in which a monofilament and a yarn in which small-diameter raw yarns are bundled and which has fine water sucking spaces between the raw yarns, are combined and disposed, and a construction of a needle felt as comparative examples, a result of comparison tests of the textile of the example of the present invention and the textile of the prior art, will be described.

Comparative Example 1

A multi-layer textile of one-layer warp and two-layer weft of 4 shafts was used as Comparative Example 1. The textile is constructed by monofilaments in which polyamide monofilaments of a diameter of 0.60 mm are disposed in 48 per one inch in the warps, polyamide monofilaments of a diameter of 0.60 mm are disposed in 16 per one inch in the sheet surface side wefts, and polyamide monofilaments are disposed in 16 per one inch in the running surface side wefts.

Comparative Example 2

A multi-layer textile of one-layer warp and two-layer weft of 8 shafts was used as Comparative Example 2. In the textile, polyamide monofilaments of a diameter of 0.60 mm are disposed in 48 per one inch in the warp. Polyamide monofilaments of a diameter of 0.60 mm and polyamide multifilament burring process yarns in which three lines of 55 of 23 denier burring thin lines are twined together, are alternately disposed in 20 per one inch in the pulp surface side wefts. Polyamide monofilaments and polyamide multifilament burring process yarns in which three lines of 55 of 23 denier burring thin lines are twined together, are alternately disposed in 20 per one inch in the running surface side wefts.

Comparative Example 3

A needle felt in which batt made of polyamide was used as Comparative Example 3. The polyamide batt of 2.2 kg per 1 $m^2$ are cross-twined by needling into a base cloth that is woven using a polyamide monofilament twine as the warps and a polyamide monofilament twine as the wefts.

Although the textile of Comparative Example 1 is superior in washability and rigidity, it lacks the softness and the cushioning property, and there is a case that the construction material sheet breaks under a high nip pressure. Besides, the two-layer textile of Comparative Example 2 generates elongation as it is used, and because of a structure in which yarns in which the small-diameter raw yarns are bundled to form the fine water sucking spaces between the raw yarns, are disposed in two layers, the material, stain, and so on, come into the layer, and washing was difficult. Although the needle felt of Comparative Example 3 is good in water sucking ability, it lacks the showering resistance, washability, cushioning property, nip resistance, and so on, crush is generated as it is used, it is gradually compressed and the thickness decreases, and accordingly there was a problem that the water sucking ability decreases.

Comparison Test

The textiles of Example and Comparative Example are placed and inserted in a construction material forming machine, and run at a forming speed of 15 m/min, and the construction material show below is supplied onto the textiles to form, and after this, pressed at a making roll press pressure of about 5 kg/cm, and the construction sheet formation was performed.

| Construction Material | |
|---|---|
| Slag | 37.3% |
| Plaster | 37.3% |
| Admixture | 20.2% |
| Pulp | 4.9% |
| Chemical fiber | 0.3% |

1) Retention Test

A great deal of water and the above material whose weight was known were supplied to the textile, the absolute dry weight of the sheet formed through the processes such as forming, press, drying, and so on, was measured, the supplied material and the formed sheet were compared in weight, and the retention was calculated.

TABLE 1

| | Retention |
|---|---|
| Example 1 | 95.6% |
| Comparative Example 1 | 84.3% |
| Comparative Example 2 | 95.8% |
| Comparative Example 3 | 95.9% |

The textiles other than Comparative Example 1 could obtain substantially the same retention.

2) Extensional Rigidity Test

The textile was run for 10 days by the above-described conditions, and the lengths of the textile before use and after use were measured, compared, and evaluated.

TABLE 2

| | Extensional Rigidity |
|---|---|
| Example 1 | ◎ |
| Comparative Example 1 | ○ |
| Comparative Example 2 | X |
| Comparative Example 3 | X |

| Evaluation Method | good | bad |
|---|---|---|
| Little elongation | ◎ > ○ > Δ > X | Large elongation |

The textile of Comparative Examples 2 and 3 generated elongation as they were used and bending was generated, and finally, a phenomenon that a crack was generated in the sheet was observed.

3) Surfaceability

The surface of a construction material sheet manufactured using each textile by the above same conditions was observed.

TABLE 3

| | Surfaceability |
|---|---|
| Example 1 | ◎ |
| Comparative Example 1 | X |
| Comparative Example 2 | ◎ |
| Comparative Example 3 | ◎ |

| Evaluation Method | good | bad |
|---|---|---|
| No mark on surface | ◎ > ○ > Δ > X | Mark on surface |

In the textile formed by the monofilament of Comparative Example 1, since the sheet formation surface was not fine, the mesh of the textile was transferred to the sheet.

4) Showing resistance, Washability

The Example and the Comparative Examples were set on frames and high-pressure shower was applied under the following conditions, and the durability to shower and washability were compared.

Shower pressure: 2.5 MPa

Nozzle diameter: 1 mm

Distance: 100 mm

Slide distance: 50 mm in warp direction, 50 mm in weft direction

Slide speed: 50 mm/30 sec in warp direction, 50 mm/30 sec. in weft direction

Shower time: 30 minutes

TABLE 4

| | Showering resistance | Washability |
|---|---|---|
| Example 1 | ◎ | ◎ |
| Comparative Example 1 | ◎ | ◎ |
| Comparative Example 2 | ◎ | Δ |
| Comparative Example 3 | X | X |

Evaluation Method Showering resistance: Good ◎ > ○ > Δ > X Bad and washability

Although, in Comparative Example 3, falling-off of down, fenestration, and so on, were observed, in Example 1, Comparative Examples 1, 2, and 3, no damage such as fenestration, break of a yarn, or the like, were observed. As for washability, while, in Example 1 and Comparative Example 1, the material and stain in the textile layer were sufficiently removed, in Comparative Example 2, the material or the like remained in part in the layer, and in Comparative Example 3, it was observed that the material remained in the root portion of the batt needled to the base cloth.

By the results of the comparison tests as above, as for surfaceability and retention, substantially the same good results were obtained other than Comparative Example 1. As for extensional rigidity, while the textile of Example hardly elongated, in Comparative Example 1, a little elongation was observed, besides, in Comparative Examples 2 and 3, elongation was gradually generated by a tension. Besides, as for showering resistance and washability, in Example 1 and Comparative Example 1, good results were obtained. From these results, the textile in which good results were obtained in all of surfaceability, retention, extensional rigidity, showering resistance, and washability, is only Example of the present invention.

In the press fabric of the present invention, as elongation measure, one warp is always the same crimp shape. Because it is a single layer structure constructed by two warps different in size of crimp, the elongation of the textile can be made small, because a congregation of fine fibers is present in the textile, it is superior in water sucking ability, since it has a fine sheet formation surface, a mark is not transferred to the construction material sheet, and because the total of the textile is a woven fabric structure, the warp and the weft are mutually bound, since the water sucking spaces are hard to crush, the water sucking ability never decreases thereby, and a construction yarn is never break and fallen by collision of shower water. Besides, by making into the single layer structure, it became a textile very superior in washability.

The textile used in the construction material manufacturing machine of the present invention is that, because it is a single layer structure in which the warp comprises two warps in which one warp always forms the crimp of the same shape, it is superior in extensional rigidity, by using a monofilament in the warp, it is superior in elongating resistance and rigidity, by using a yarn in which small-diameter raw yarns are bundled to form fine water sucking spaces between the raw yarns, at least in part of the warp and/or the weft, the retention, water sucking ability, and surfaceability are improved, by making into a single layer structure in which these yarns are combined, it is superior in showering resistance and washability, and by making into such a structure, it exhibits an effect superior in sheet formation.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2001-226777 filed Jun. 22, 2001 including specification, drawings and claims is incorporated herein by reference in its entirety.

What is claimed is:

1. A single layer textile for manufacturing a construction material, comprising single layer warps and first and second single layer wefts; wherein each of the warps is a monofilament containing warp selected from a group consisting of a monofilament, a monofilament twines and a core line yarn having a core line of a monofilament; wherein each of the first wefts is a monofilament; wherein each of the second wefts is the a bundled yarn in which small-diameter raw yarns are bundled to form fine water sucking spaces between the raw yarns; and wherein the warps are woven with the first and second wefts.

2. The single layer textile for manufacturing construction material according to claim 1, wherein said single layer warps include at least a first warp and a second warn, and wherein the first warp that forms a first knuckle on the first weft always forms first knuckles on the first wefts and the first warp that forms a second knuckle on the second weft always forms second knuckles on the second wefts; each of the first knuckles has a first shape and each of the second knuckles has a second shape, the first and second shapes are different.

3. The single layer textile for manufacturing the construction material according to claim 1, wherein the first and second wefts are alternately disposed; and a tissue of the warps comprises (i) first warps that pass over the first weft, and next pass under the second weft, the first weft, and the second weft, and (ii) second warps that passes over the second weft, and next pass under the first weft, the second weft, and the first weft.

4. The single layer textile for manufacturing the construction material according to claim 1, wherein the single layer textile comprises no less than 30% of the monofilament, the monofilament twine and the core line yarns.

5. The single layer textile for manufacturing the construction material according to claim 1, wherein the bundled yarn is selected from a group consisting of a open-spun yarn, a multifilament, a raising yarn, a monofilament twine, a mole yarn, a filament process yarn, a yarn in which a spun yarn is wound on a core line of a monofilament, and a yarn in which at least two kinds of these yarns are co-twined.

6. The single layer textile for manufacturing the construction material according to claim 1, wherein the core line yarn is a yarn in which a spun yarn or a multifilament is wound on a core line of a monofilament.

7. A single layer textile for manufacturing a construction material, comprising single layer warps and single layer first and second wefts; wherein warps comprises a bundled yarn in which small-diameter raw yarns are bundled to form fine water sucking spaces between the raw yarns and a monofilament containing warp selected from a group consisting of a monofilament, a monofilament twine, and a core line yarn having a core line of a monofilament; each of the first wefts is a monofilament; and each of the second wefts is said bundled yarn; and the warps are woven with the first and second wefts.

8. The single layer textile for manufacturing construction material according to claim 7, wherein said warps include at least a first warp and a second warp, and wherein the first warp that forms a first knuckle on the first weft always forms first knuckles on the first wefts and the second warp that forms a second knuckle on the second weft always forms second knuckles on the second wefts; each of the first knuckles has a first shape and each of the second knuckles has a second shape, the first and second shapes are different.

9. The single layer textile for manufacturing the construction material according to claim 7, wherein the first and second wefts are alternately disposed; and a tissue of the warps comprises (i) first warps that pass over the first weft, and next pass under the second weft, the first weft, and the second weft, and (ii) second warps that passes over the second weft, and next pass under the first weft, the second weft, and the first weft.

10. The single layer textile for manufacturing the construction material according to claim 7, wherein the bundled yarn is selected from a group consisting of a spun yarn, a multifilament, a raising yarn, a monofilament twine, a mole yarn, a filament process yarn, a yarn in which a spun yarn is wound on a core line of a monofilament, and a yarn in which at least two kinds of these yarns are co-twined.

11. (NBW) The single layer textile for manufacturing the construction material according to claim 7, wherein the core line yarn is a yarn in which a span yarn or a multifilament is wound on a core line of a monofilament.

12. The single layer textile for manufacturing the construction material according to claim 7, wherein the single layer textile comprises no less than 30% of the monofilament, the monofilament twine and the core line yarns.

* * * * *